US007014481B2

(12) United States Patent
Miyamoto

(10) Patent No.: US 7,014,481 B2
(45) Date of Patent: Mar. 21, 2006

(54) CARD CONNECTOR

(75) Inventor: Osamu Miyamoto, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/201,136

(22) Filed: Aug. 11, 2005

(65) Prior Publication Data

US 2006/0040530 A1 Feb. 23, 2006

(30) Foreign Application Priority Data

Aug. 20, 2004 (JP) ..... 2004-240912

(51) Int. Cl.
*H01R 13/658* (2006.01)

(52) U.S. Cl. ..... 439/95

(58) Field of Classification Search ..... 439/95
See application file for complete search history.

(56) References Cited

U.S. PATENT DOCUMENTS 5,470,259 A * 11/1995 Kaufman et al. ..... 439/607
5,478,260 A * 12/1995 Kaufman et al. ..... 439/609
6,685,509 B1 * 2/2004 Yeh ..... 439/95
6,840,807 B1 * 1/2005 Ooya et al. ..... 439/607

FOREIGN PATENT DOCUMENTS

JP 10-32047 2/1998

* cited by examiner

*Primary Examiner*—Briggitte R. Hammond
(74) *Attorney, Agent, or Firm*—Takeuchi & Kubotera, LLP

(57) ABSTRACT

A card connector includes an insulating housing having a signal terminal and a ground terminal arranged therein and a metal cover attached to the insulating housing for forming a card receptacle space therebetween. The metal cover is provided, at a rear end surface thereof, with a ground contacting portion and a holding portion disposed near the ground contacting portion. When the metal cover is attached to the insulating housing, the ground contacting portion of the metal cover contacts with a metal cover contacting portion of the ground terminal disposed in an opening of a ground terminal arranging portion of the insulating housing. Further, the holding portion of the metal cover engages an engagement portion of the insulating housing. Accordingly, it is possible to electrically connect the metal cover and the ground terminal with high reliability without increasing an outer size of the connector.

9 Claims, 6 Drawing Sheets

CARD CONNECTOR

BACKGROUND OF THE INVENTION

The present invention relates to a card connector, especially a card connector for a small memory card.

A conventional card connector includes an insulating housing having a signal terminal and a ground terminal arranged therein and a metal cover covering an outer surface of the insulating housing. Japanese Patent Publication No. 10-32047 has disclosed a card connector in which a ground surface of a card is electrically connected to the ground terminal through the metal cover when the card is inserted into a card receptacle space of the insulating housing, thereby improving grounding effect.

In the conventional card connector described above, the ground terminal has a structure in which connection is secured through elastic connection or permanent connection with a spring. Accordingly, it is necessary to provide a spring, thereby increasing a size of the connector. Further, the spring may deform the insulating housing, and the assembly process tends to be cumbersome.

In view of the problems described above, an object of the present invention is to provide a card connector, especially a card connector for a small card, capable of solving the problems of the conventional card connector.

Further objects and advantages of the invention will be apparent from the following description of the invention.

SUMMARY OF THE INVENTION

In order to attain the objects described above, according to the present invention, a card connector includes an insulating housing having a signal terminal and a ground terminal arranged therein and a metal cover attached to the insulating housing for forming a card receptacle space therebetween. A signal contact portion and a ground contact portion formed on a surface of a card contact with the corresponding signal terminal and ground terminal when the card is inserted into the card receptacle space through a front end thereof.

The insulating housing is provided, at a rear end portion thereof, with a signal terminal arranging portion and a ground terminal arranging portion where the signal terminal and the ground terminal are arranged, respectively. The ground terminal is disposed in the ground terminal arranging portion near a rear end surface of the insulating housing. The ground terminal includes a connecting portion to be connected to a ground conductor of a circuit board with the card connector mounted thereon; an elastic arm portion extending from the connecting portion toward a front side of the card receptacle space; and a card contacting portion at a distal end of the elastic arm portion for contacting with the ground contact portion of the card.

A metal cover contacting portion is disposed between the elastic arm portion and the connecting portion near the rear end surface of the insulating housing in the ground terminal arranging portion. The metal cover is provided, at a rear end surface thereof, with a ground contacting portion and a holding portion disposed near the ground contacting portion. The ground contacting portion of the metal cover includes an elastic arm portion extending downwardly from an upper surface of the metal cover, and a contacting portion disposed at a lower end portion of the elastic arm portion. The holding portion of the metal cover includes a holding arm portion extending downwardly from the upper surface of the metal cover, and an engaging portion disposed on the holding arm portion.

When the metal cover is attached to the insulating housing, the contacting portion of the ground contacting portion of the metal cover contacts with the metal cover contacting portion of the ground terminal. Further, the engaging portion of the holding portion of the metal cover engages an engagement portion disposed at a corresponding position of the insulating housing.

According to the present invention, the holding portion of the metal cover may be disposed at both sides of the ground contacting portion of the metal cover.

According to the present invention, the engagement portion disposed at a corresponding position of the insulating housing may be disposed in an opening of the signal terminal arranging portion of the insulating housing. The metal cover contacting portion of the ground terminal may have a curved portion. The ground contacting portion of the metal cover may have a curved contacting portion curving into the opening of the signal terminal arranging portion of the insulating housing for contacting with the curved portion of the metal cover contacting portion of the ground terminal.

According to the present invention, the engagement portion disposed at a corresponding position of the insulating housing may be disposed in an opening of the signal terminal arranging portion of the insulating housing. The metal cover contacting portion of the ground terminal may have an engagement applying portion. The ground contacting portion of the metal cover may have an L shaped contacting portion entering into the opening of the signal terminal arranging portion of the insulating housing for contacting with the metal cover contacting portion of the ground terminal. The L shaped contacting portion may include an engaging applying portion for engaging the engagement applying portion of the metal cover contacting portion.

According to the present invention, the contacting portion of the ground contacting portion of the metal cover enters the opening of the ground terminal arranging portion from behind, and is pressed against the metal cover contacting portion of the ground terminal. At the same time, the engaging portion of the holding portion of the metal cover enters the opening of the signal terminal arranging portion from behind, and engages the engagement portion. Accordingly, the metal cover is attached to the insulating housing in an inclined state. Afterward, the metal cover is rotated toward the upper surface of the insulating housing to be attached to the insulating housing. The engaging portion of the holding portion of the metal cover extends into the opening of the signal terminal arranging portion of the insulating housing from the front end surface of the holding arm portion to engage the engagement portion.

According to the present invention, the engagement portion disposed at a corresponding position of the insulating housing may be formed of an engagement projection formed on the rear end surface of the insulating housing. The metal cover contacting portion of the ground terminal may have a curved portion. The contacting portion of the ground contacting portion of the metal cover may have a curved contacting portion curving into the opening of the signal terminal arranging portion of the insulating housing for contacting with the curved portion of the metal cover contacting portion of the ground terminal. The engaging portion of the holding portion of the metal cover may include an engagement hole for engaging the engagement projection formed on the rear end surface of the insulating housing.

According to the present invention, the contacting portion of the ground contacting portion of the metal cover enters the opening of the ground terminal arranging portion from behind, and is pressed against the metal cover contacting portion of the ground terminal. At the same time, the engaging hole of the holding portion of the metal cover engages the engagement projection formed on the rear end surface of the insulating housing. Accordingly, the metal cover is pushed into the insulating housing from above to be attached to the insulating housing.

According to the present invention, the ground terminal may include position regulating portions on both sides of the metal cover contacting portion at the rear end of the elastic arm portion.

According to the present invention, the elastic arm portion of the ground terminal and the card contacting portion extend toward a side opposite to the metal cover with the card receptacle space in between.

DETAILED DESCRIPTION OF THE PREFERRED EMBODIMENTS

Figure 1:
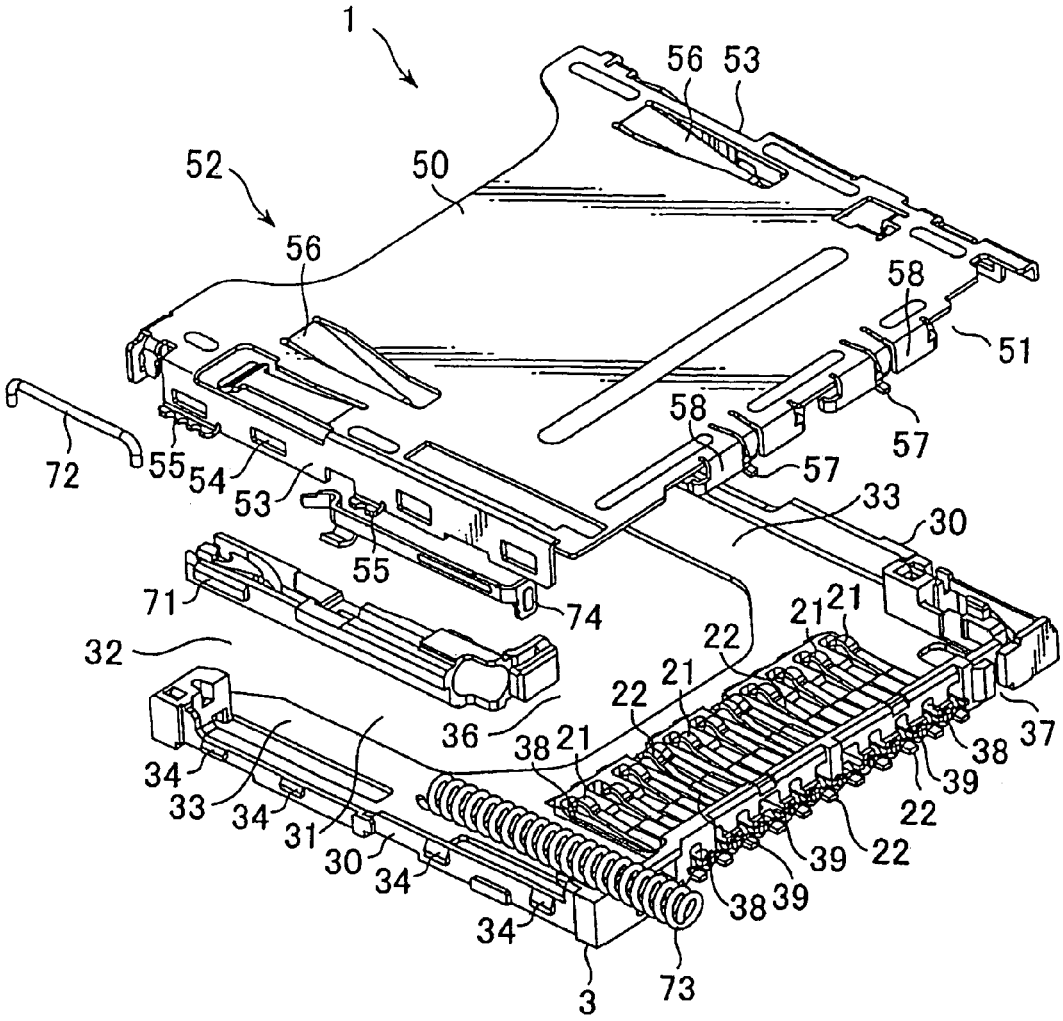
FIG. 1 is an exploded perspective view showing a card connector according to an embodiment of the present invention.
Figure 2:
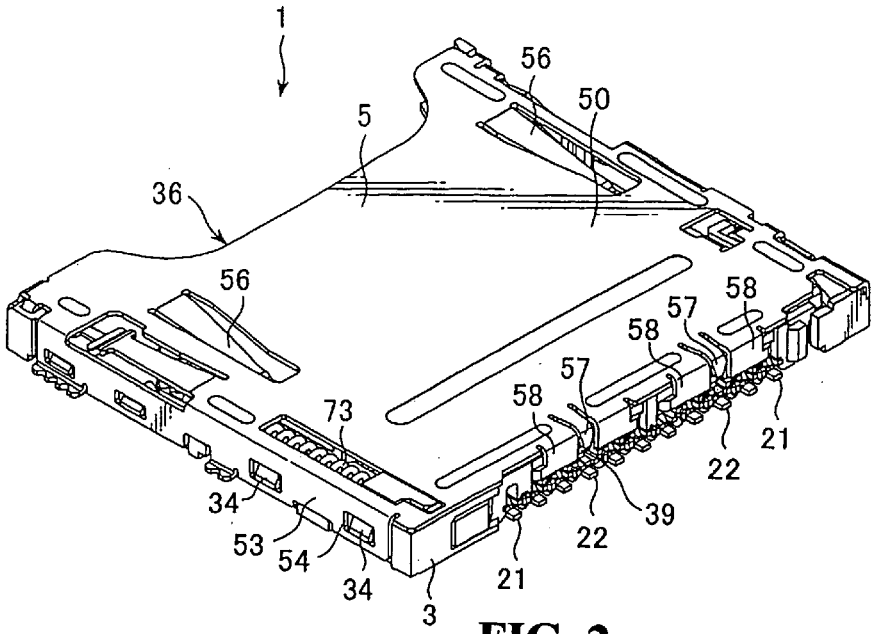
FIG. 2 is a perspective view showing the card connector shown in FIG. 1 in an assembled state.

Hereunder, embodiments of the present invention will be explained with reference to the accompanying drawings. FIG. 1 is an exploded perspective view showing a card connector for a small memory card according to an embodiment of the present invention. FIG. 2 is a perspective view showing the card connector for a small memory card shown in FIG. 1 in an assembled state. As shown in FIGS. 1 and 2, a card connector 1 for a small memory card includes an insulating housing 3; signal terminals 21 and ground terminals 22 disposed in the insulating housing 3; and a metal cover 5. The card connector further includes an injector 71, a pin 72, a spring 73, and a lock device 74 as an insertion control unit of a card. The insertion control unit has a well-known structure, and an explanation thereof is omitted.

The insulating housing 3 is formed of, for example, a resin material. The insulating housing 3 has an open upper surface 31 and an open front end surface 32. The metal cover 5 substantially covers the open upper surface 31 of the insulating housing 3, so that a card receptacle space 36 is formed between a lower surface 33 of the insulating housing 3 and the metal cover 5. Projecting portions 34 having an inclined surface are formed on both side surfaces 30 of the insulating housing 3 for fixing the metal cover 5 to the insulating housing 3. Fixing holes 54 are formed at positions corresponding to both side surfaces 53 of the metal cover 5. As shown in FIG. 2, the metal cover 5 is fitted to the insulating housing 3, and the projecting projections 34 are snap-fitted into the corresponding fixing holes 54, thereby fixing the metal cover 5 to the upper surface of the insulating housing 3.

A card to be inserted into the card receptacle space 36 includes a flat IC card such as a memory card for general use. In general, such a card is provided with a signal contact portion for transmitting a signal and a ground contact portion for connecting ground arranged on a surface thereof opposite to a surface having a logo of the card. The number and locations of the signal contact portion and the ground contact portion are generally determined according to the standard. In the embodiment, as an example, the card has nine signal contact portions and two ground contact portions. The card is inserted into the card receptacle space 36 through an open front end surface of the card connector 1.

Seven signal terminal arranging portions 38 for arranging the signal terminals 21 and two ground terminal arranging portions 39 for arranging the ground terminals 22 are disposed on a rear end surface 37 of the insulating housing 3. The signal terminal arranging portions 38 and the ground terminal arranging portions 39 are arranged in one direction to form a terminal arranging portion. The signal terminals 21 and the ground terminals 22 are arranged and fixed to the signal terminal arranging portions 38 and the ground terminal arranging portions 39 in a direction that the IC card is inserted into the card receptacle space 36, respectively. They are fixed through a well-known structure such as press-fitting, and explanation thereof is omitted.

The metal cover 5 is formed of a metal thin plate having conductivity and spring property with a process of punching out and bending. The metal cover 5 generally functions as an impact protection member and a shielding member. In the present embodiment, the metal cover 5 also functions as a member for ground connection of the IC card. Ground connecting portions 55 may be disposed on lower ends of the side surfaces 53 of the metal cover 5 at appropriate locations for contacting with a ground conductor formed on a circuit board, on which the card connector 1 is mounted.

Ground contact portions 57 and holding portions 58 at both sides of the ground contact portions 57 are disposed on the rear end surface 51 of the metal cover 5 at positions corresponding to the ground terminals 22 arranged at the ground terminal arranging portions 39 of the insulating housing 3. A front end surface 52 of the metal cover 5 is opened in an entire portion thereof for inserting the memory card such as an IC card. The side surfaces 53 of the metal cover 5 are substantially closed. Card holding displacement portions 56 are disposed at both front sides of an upper surface 50 of the metal cover 5 for fixing the card inserted into the card receptacle space 36. The card holding displacement portions 56 are formed by cutting parts of the metal cover 5 and bending toward the card receptacle space 36. The card holding displacement portions 56 press the card inserted into the card receptacle space 36 toward the circuit board on which the card connector 1 is mounted, thereby preventing the card from coming off.

Figure 3:
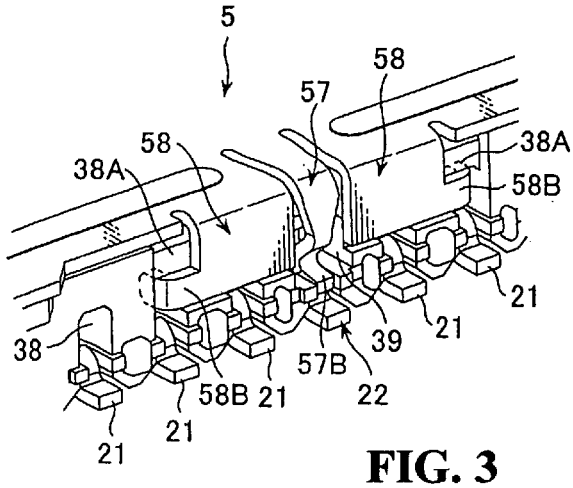
FIG. 3 is an enlarged view showing the vicinity of a ground terminal disposed at a rear end portion of the card connector shown in FIGS. 1 and 2.
Figure 4:
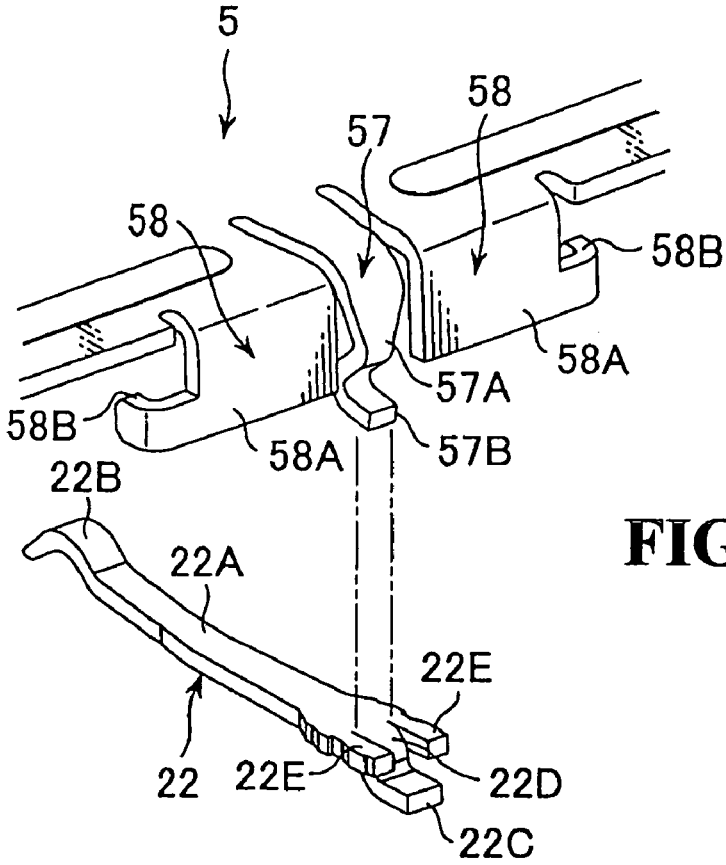
FIG. 4 is an exploded perspective view showing a ground contacting portion of a metal cover and a ground terminal disposed in an insulating housing of the card connector shown in FIGS. 1 and 2.
Figure 5:
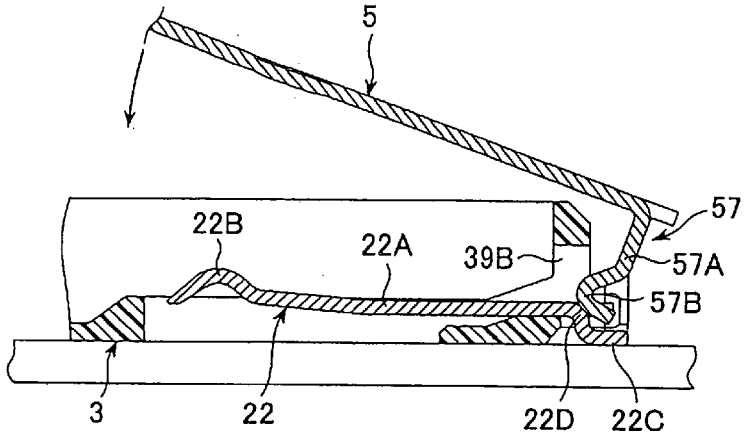
FIGS. 5(A) and 5(B) are views showing an operation of assembling the metal cover and the insulating housing of the card connector.
Figure 5:
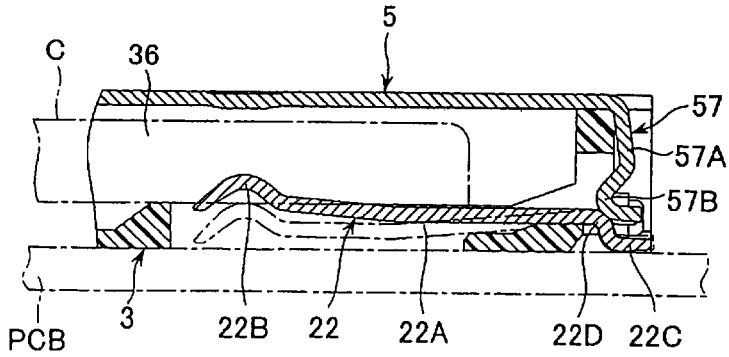
Figure 6:
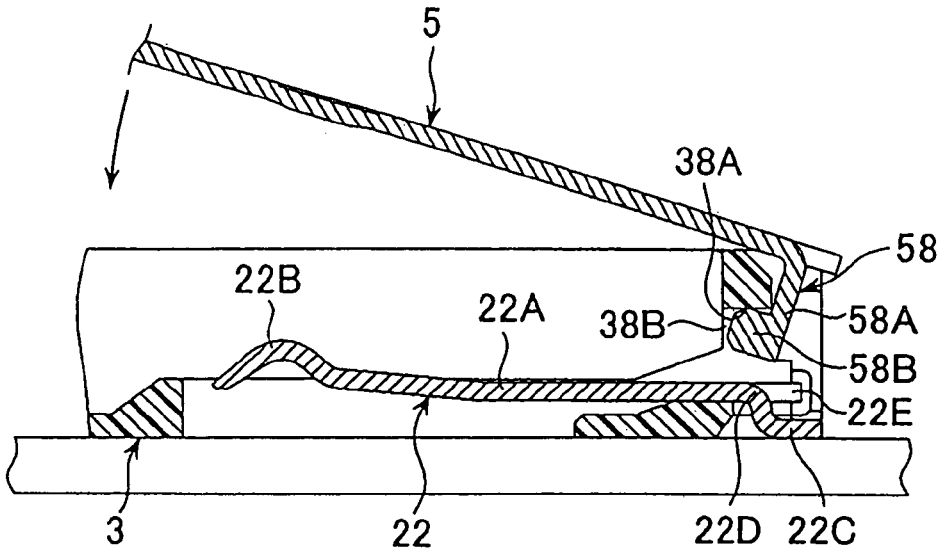
FIGS. 6(A) and 6(B) are views showing an operation of assembling the metal cover and the insulating housing of the card connector.
Figure 6:
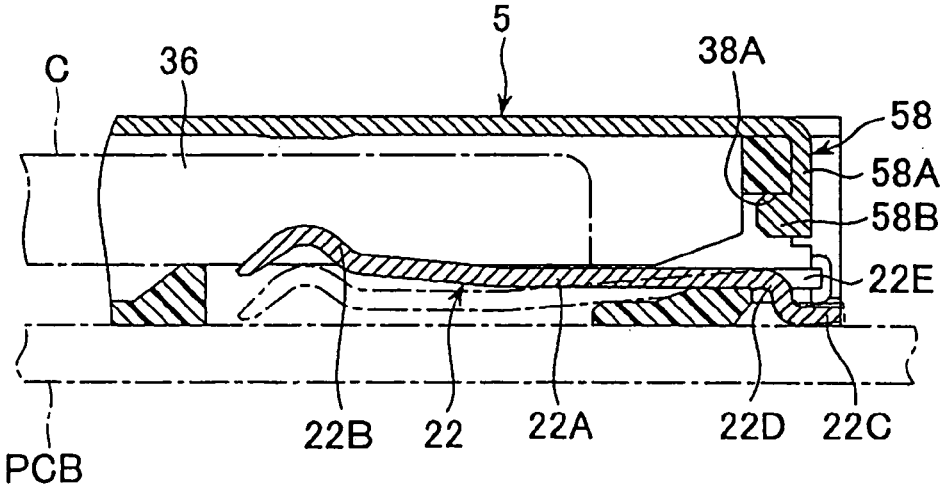

With reference to FIGS. 3 to 6(A) and 6(B), detailed structures and operations of the ground contact portions 57 and the holding portions 58 disposed on the metal cover 5 as well as the insulating housing 3 will be explained. FIG. 3 is an enlarged view showing the ground terminal 22 and the vicinity thereof disposed at the rear end portion of the card connector 1 shown in FIGS. 1 and 2 in a state that the insulating housing 3 of the card connector 1 is assembled with the metal cover 5. FIG. 4 is an exploded perspective view showing the ground contacting portion 57 of the metal cover 5 and the ground terminal 22 disposed in the insulating housing 3.

As shown in FIG. 4, the ground contacting portion 57 includes an elastic arm portion 57A extending downwardly and a curved contact portion 57B disposed at a distal end of the elastic arm portion 57A. The holding portions 58 include holding arm portions 58A extending downwardly and engaging portions 58B extending from front side surfaces of the holding arm portions 58A. The ground terminal 22 includes an elastic arm portion 22A; a card contact portion 22B disposed at a front end of the elastic arm portion 22A for contacting with the ground contact portion of the card inserted into the card receptacle space 36; a connecting portion 22C disposed at a rear end of the elastic arm portion 22A for connecting the ground conductor of the circuit board when the card connector 1 is mounted on the circuit board; a metal cover contacting portion 22D formed of a curved portion connected to the contacting portion 22C; and position regulating portions 22E disposed on both sides of the metal cover contacting portion 22D at the rear end of the elastic arm portion 22A.

The ground contacting portion 57 and the holding portion 58 are formed through punching and bending the rear end portion of the metal cover 5 into a specific shape. The ground terminal 22 is formed of a metal material having conductivity and spring property with a process of punching out and bending.

When the metal cover 5 is assembled with the insulating housing 3 as described later, as shown in FIG. 3, the ground contacting portion 57 disposed on the metal cover 5 is arranged such that the curved contact portion 57B elastically contacts with the metal cover contacting portion 22D of the ground terminal 22 arranged at the ground terminal arranging portion 39 of the insulating housing 3, thereby electrically connecting the ground terminal 22 to the metal cover 5. At this time, the position regulating portions 22E disposed on the ground terminal 22 guide the curved contact portion 57B of the ground contacting portion 57 into the metal cover contacting portion 22D of the ground terminal 22 and regulate a position thereof.

When the metal cover 5 is assembled with the insulating housing 3 as described later, as shown in FIG. 3, the holding portions 58 disposed on the metal cover 5 are arranged such that the engaging portions 58B engage engagement portions 38A disposed at the signal terminal arranging portions 38 of the rear end surface 37 of the insulating housing 3 to hold the insulating housing 3. Accordingly, the curved contact portion 57B contacts with the metal cover contacting portion 22D to prevent the metal cover 5 from separating from the insulating housing 3 and curving or deforming due to re-flow heating. When the ground terminal 22 is arranged at a center of the arrangement, it is preferred to arrange the holding portion at the arranging area for securing the prevention. In the engagement, it is not necessary to establish direct contact, and it is sufficient to provide the regulation effect when a trouble such as lifting occurs.

With reference to FIGS. 5(A), 5(B), 6(A) and 6(B), a process of assembling the connector 1 for a small memory card having the insulating housing 3 and the metal cover 5 with the structures described above will be explained next. FIGS. 5(A) and 5(B) are sectional views taken along a vertical center line of the ground terminal 22. FIG. 5(A) is a view showing an operation of assembling the metal cover 5 with the insulating housing 3 in an initial stage, and FIG. 5(B) is a view showing an operation of assembling the metal cover 5 with the insulating housing 3 in a complete stage. In FIG. 5(B), a circuit board PCB and a card C are represented by projected lines for better understanding a state that the connector 1 is mounted on the circuit board and the card is inserted into the card receptacle space 36 of the card connector 1.

FIGS. 6(A) and 6(B) are sectional views taken along a line passing the engaging portion 58B of the holding portion 58 of the metal cover 5. FIG. 6(A) is a view showing an operation of assembling the metal cover 5 with the insulating housing 3 in an initial stage similar to FIG. 5(A), and FIG. 6(B) is a view showing an operation of assembling the metal cover 5 with the insulating housing 3 in a complete stage similar to FIG. 5(B). In FIG. 6(B), the circuit board PCB and the card C are represented by projected lines for better understanding the state that the connector 1 is mounted on the circuit board and the card is inserted into the card receptacle space 36 of the card connector 1.

Before assembling the metal cover 5 with the insulating housing 3, the signal terminals 21 and the ground terminals 22 are press-fitted to the signal terminal arranging portions 38 and the ground terminal arranging portions 39 of the insulating housing 3 at proper positions. When the metal cover 5 is assembled with the insulating housing 3 with the signal terminals 21 and the ground terminals 22 thus arranged, first, as shown in FIG. 5(A), the curved contact portions 57B of the ground contact portions 57 disposed on the metal cover 5 enter an opening 39B of the ground terminal arranging portions 39 of the insulating housing 3 from behind, and are pressed against the metal cover contacting portion 22D of the ground terminals 22 disposed there. At the same time, as shown in FIG. 6(A), the engaging portions 58B of the holding portions 58 disposed at both sides of each of the ground contact portions 57 of the metal cover 5 enter the opening 38B of the signal terminal arranging portions 38 from behind, and engage the engagement portions 38A of the signal terminal arranging portions 38. Accordingly, the metal cover 5 is assembled with the insulating housing 3 in an inclined state.

Then, the metal cover 5 is rotated around contact points between the curved contact portions 57B and the metal cover contacting portions 22D and contact points between the engaging portions 58B and the engagement portions 38A in an arrow direction shown in FIGS. 5(A) and 6(A). At last, the projecting portions 34 at the side surfaces 30 of the insulating housing 3 are snap-fitted into the fixing holes 54 at the side surfaces 53 of the metal cover 5. FIGS. 5(B) and 6(B) are views showing the state that the metal cover 5 is completely assembled with the insulating housing 3.

Figure 7:
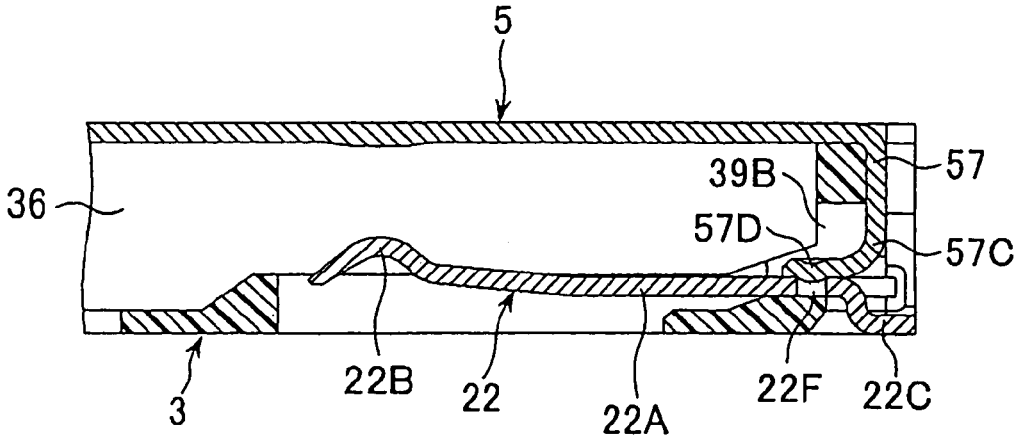
FIG. 7 is a view showing a card connector according to another embodiment of the present invention.

FIG. 7 is a view similar to FIG. 5(B) showing a card connector according to another embodiment of the present invention. In the previous embodiment, the curved contact portions 57B are disposed at the distal ends of the ground contact portions 57 of the metal cover 5 for contacting with the metal cover contacting portions 22D of the ground terminals 22. In the present embodiment shown in FIG. 7, an L-shaped contacting portion 57C is disposed at the distal end of the ground contacting portion 57 for entering the opening 39B of the ground terminal arranging portions 39 to a large extent. A projecting portion 57D is formed at the central portion of a lower leg of the L-shaped contacting portion 57C.

An engaging hole 22F is formed in the rear end of the elastic arm portion 22A of the ground terminal 22 at a corresponding position for receiving the projecting portion 57D of the ground contact portion 57. In the embodiment shown in FIG. 7, the lower legs of the L-shaped contacting portions 57C of the ground contact portions 57 contact with the rear end portions of the elastic arm portions 22A of the ground terminals 22, so that the ground terminals 22 electrically contact with the metal cover 5. Accordingly, it is possible to prevent the contacting portions between the metal cover 5 and the ground terminals 22 from shifting, thereby improving reliability. Further, when an amount of solder of the mounting circuit board is increased, it is possible to flow the solder to the connecting portions when the card connector 1 is mounted on the circuit board with soldering, thereby improving contact reliability. The engagement between the metal cover 5 and the ground terminals 22 is not limited to that in the embodiment, and may be modified. For example, the projecting portion and the hole are reversed, or two projecting portions may be provided.

Figure 8:
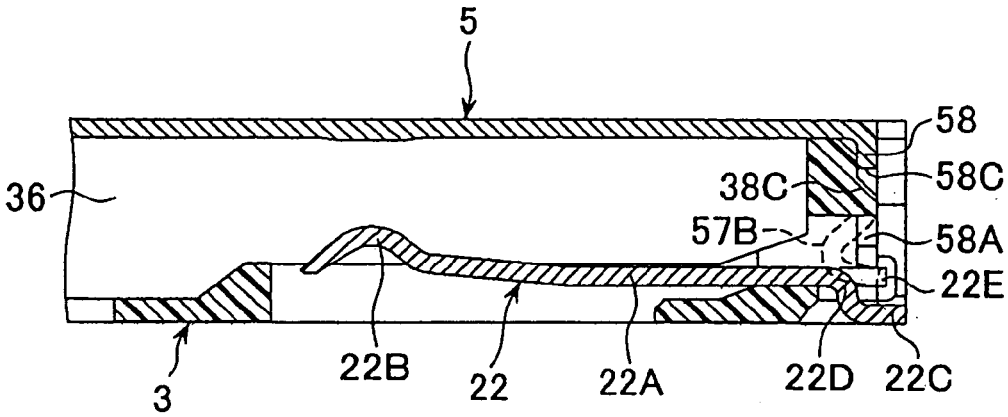
FIG. 8 is a view showing a card connector according to a further embodiment of the present invention.

FIG. 8 is a view similar to FIG. 6(B) showing a card connector according to a further embodiment of the present invention. In the previous embodiment, when the metal cover 5 is assembled with the insulating housing 3, the metal cover 5 is attached to the insulating housing 3 in an inclined state, and then rotated. In the embodiment shown in FIG. 8, it is possible to attach the metal cover 5 to the insulating housing 3 from right above in a substantially vertical state. In the present embodiment, instead that the engaging portions 58B are disposed on the holding arm portions 58A of the holding portions 58 of the metal cover 5, engagement holes 58C are formed in the holding arm portions 58A of the holding portions 58 of the metal cover 5. Engagement projections 38C are formed on the side surfaces 30 of the insulating housing 3 at corresponding positions.

In the embodiment shown in FIG. 8, the metal cover 5 is pushed into the insulating housing 3 from right above, so that the engagement projections 38C are fitted in the engagement holes 58C. At the same time, the projecting portions 34 with an inclined surface at the side surfaces 30 of the insulating housing 3 are snap-fitted into the fixing holes 54 at the side surfaces 53 of the metal cover 5, thereby assembling the metal cover 5 with the insulating housing 3. It is also possible to integrate the grand terminals and the holding portions. That is, holding arm portions extending downwardly from the upper surface of the metal cover; and engaging portions and elastic arm portions are provided on the holding arm portions. Contacting portions are provided at lower end portions of the elastic arm portions. Accordingly, it is possible to shear parts of the holding arm portions and the elastic arm portions.

As described above, according to the present invention, the holding portions are disposed near the ground contact portions of the metal cover for holding the metal cover and the insulating housing from separating from each other due to a pressing force between the metal cover and the ground terminals. Accordingly, it is possible to prevent the metal cover from lifting from the insulating housing due to a pressing force between the metal cover and the ground terminals, and also prevent the metal cover from curving or deforming due to re-flow heating. Further, it is easy to assemble the metal cover with the insulating housing without soldering. Therefore, according to the present invention, it is possible to provide a small connector with high contact reliability at low cost.

The disclosure of Japanese Patent Application No. 2004-240912, filed on Aug. 20, 2004, is incorporated in the application.

While the invention has been explained with reference to the specific embodiments of the invention, the explanation is illustrative and the invention is limited only by the appended claims.

What is claimed is:

1. A card connection device for receiving and connecting a card having a signal contact portion and a ground contact portion, comprising:

an insulating housing;

a metal cover attached to the insulating housing for forming a card receptacle space therebetween;

a signal terminal disposed in the insulating housing for contacting with the signal contact portion when the card is inserted into the card receptacle space;

a ground terminal disposed at a rear end portion of the insulating housing for contacting the ground contact portion when the card is inserted into the card receptacle space;

a signal terminal arranging portion disposed at the rear end portion of the insulating housing for arranging the signal terminal; and a ground terminal arranging portion disposed at the rear end portion of the insulating housing for arranging the ground terminal;

wherein said ground terminal includes, a connecting portion to be connected to a ground conductor of a circuit board which the card connector is to be mounted on, a first elastic arm portion extending from the connecting portion toward a front side of the card receptacle space, a card contacting portion at a distal end of the first elastic arm portion for contacting with the ground contact portion, and a metal cover contacting portion disposed between the first elastic arm portion and the connecting portion;

said metal cover includes, a ground contacting portion disposed at a rear end surface thereof, and having a second elastic arm portion extending from the metal cover and a contacting portion disposed at a lower end portion of the second elastic arm portion, and a holding portion disposed near the ground contacting portion, and having a holding arm portion extending downwardly from the upper surface of the metal cover and an engaging portion disposed on the holding arm portion; and said insulating housing includes, an engagement portion disposed at a position corresponding to the engaging portion for engaging the engaging portion so that the contacting portion contacts with the metal cover contacting portion when the metal cover is attached to the insulating housing.

2. The card connection device according to claim 1, wherein said holding portion includes holding members disposed at both sides of the ground contacting portion.

3. The card connection device according to claim 1, wherein said engagement portion is disposed in an opening of the signal terminal arranging portion; said metal cover contacting portion includes a curved portion; and said ground contacting portion includes a curved contacting portion curving into the opening of the signal terminal arranging portion for contacting with the curved portion.

4. The card connection device according to claim 1, wherein said engagement portion includes an engagement projection formed on the rear end portion of the insulating housing; said metal cover contacting portion includes a curved portion; said contacting portion of the ground contacting portion includes a curved contacting portion curving into an opening of the signal terminal arranging portion for contacting with the curved portion; and said engaging portion of the holding portion includes an engagement hole for engaging the engagement projection.

5. The card connection device according to claim 1, wherein said contacting portion of the ground contacting portion enters an opening of the ground terminal arranging portion from behind and is pressed against the metal cover contacting portion of the ground terminal; and an engaging hole is formed in the metal cover at the holding portion for engaging the engagement projection so that the metal cover is pushed into the insulating housing from above to be attached to the insulating housing.

6. The card connection device according to claim 1, wherein said ground terminal includes position regulating portions disposed on both sides of the metal cover contacting portion at a rear end of the first elastic arm portion.

7. The card connection device according to claim 1, wherein said first elastic arm portion and said card contacting portion extend toward a side opposite to the metal cover with the card receptacle space in between.

8. The card connection device according to claim 1, wherein said engagement portion is disposed in an opening of the signal terminal arranging portion of the insulating housing; said metal cover contacting portion includes a first engagement applying portion; and said ground contacting portion of the metal cover includes an L shaped contacting portion entering the opening of the signal terminal arranging portion for contacting with the metal cover contacting portion, said L shaped contacting portion having a second engagement applying portion for engaging the first engagement applying portion.

9. The card connection device according to claim 8, wherein said contacting portion enters an opening of the ground terminal arranging portion from behind and is pressed against the metal cover contacting portion of the ground terminal; said engaging portion enters the opening of the signal terminal arranging portion from behind and engages the engagement portion so that the metal cover is attached to the insulating housing in an inclined state, and then the metal cover is rotated toward an upper surface of the insulating housing to be attached to the insulating housing, said engaging portion of the holding portion extending into the opening of the signal terminal arranging portion from the holding arm portion to engage the engagement portion.

* * * * *